US007079091B2

(12) United States Patent
Kondakov et al.

(10) Patent No.: US 7,079,091 B2
(45) Date of Patent: Jul. 18, 2006

(54) COMPENSATING FOR AGING IN OLED DEVICES

(75) Inventors: Denis Y. Kondakov, Kendall, NY (US); James R. Milch, Penfield, NY (US); Ralph H. Young, Rochester, NY (US); James R. Sandifer, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 481 days.

(21) Appl. No.: 10/341,944

(22) Filed: Jan. 14, 2003

(65) Prior Publication Data

US 2004/0135749 A1 Jul. 15, 2004

(51) Int. Cl.
*G09G 3/30* (2006.01)

(52) U.S. Cl. ..... 345/76; 345/82; 345/214

(58) Field of Classification Search ..... 345/82, 345/45, 46, 50, 76, 87, 211, 214; 313/500, 313/504; 315/169.1, 169.3, 169.4
See application file for complete search history.

(56) References Cited

U.S. PATENT DOCUMENTS

| | | | | |
|---|---|---|---|---|
| 3,172,862 | A | 3/1965 | Gurnee et al. | |
| 3,173,050 | A | 3/1965 | Gurnee | |
| 3,710,167 | A | 1/1973 | Dresner et al. | |
| 4,356,429 | A | 10/1982 | Tang | |
| 5,061,569 | A | 10/1991 | VanSlyke et al. | |
| 5,292,802 | A | 3/1994 | Rhee et al. | |
| 5,409,783 | A | 4/1995 | Tang et al. | |
| 5,554,450 | A | 9/1996 | Shi et al. | |
| 5,593,788 | A | 1/1997 | Shi et al. | |
| 5,683,823 | A | 11/1997 | Shi et al. | |
| 5,908,581 | A | 6/1999 | Chen et al. | |
| 6,020,078 | A | 2/2000 | Chen et al. | |
| 6,081,073 | A | 6/2000 | Salam | |
| 6,208,077 | B1 | 3/2001 | Hung | |
| 6,320,325 | B1 | 11/2001 | Cok et al. | |
| 6,414,661 | B1 * | 7/2002 | Shen et al. | 345/82 |
| 6,747,618 | B1 * | 6/2004 | Arnold et al. | 345/77 |
| 6,911,961 | B1 * | 6/2005 | Miller et al. | 345/82 |
| 2002/0167471 | A1 * | 11/2002 | Everitt | 345/76 |
| 2003/0071804 | A1 * | 4/2003 | Yamazaki et al. | 345/204 |

FOREIGN PATENT DOCUMENTS

| | | |
|---|---|---|
| WO | WO 99/41732 | 8/1999 |

OTHER PUBLICATIONS

"Double Injection Electroluminescence iin Anthracene", by J. Dresner, RCA Review, vol. 30, pp. 322-334, 1969.
"Electroluminescence of doped organic thin films", by C. W. Tang et al., J. Applied Physics, 65(9), May 1, 1989, pp. 3610-3616.
"Organic electroluminescent devices with improved stability", by S. A. VanSlyke et al., Appl. Phys. Letter 69 (15) Oct. 7, 1996, pp. 2160-2162.

* cited by examiner

*Primary Examiner*—Henry N. Tran
(74) *Attorney, Agent, or Firm*—Raymond L. Owens

(57) ABSTRACT

A method of adjusting the voltage applied across the pixels of an OLED display to compensate for aging including measuring the accumulation of trapped positive charge to produce a signal representative of such accumulation, and responding to such signal to adjust the voltages applied across the pixels of the OLED to compensate for aging.

8 Claims, 6 Drawing Sheets

COMPENSATING FOR AGING IN OLED DEVICES

FIELD OF INVENTION

This invention relates to compensating for aging in OLED devices which causes luminance loss in operating OLED devices.

BACKGROUND OF THE INVENTION

While organic electroluminescent (EL) devices have been known for over two decades, their performance limitations have represented a barrier to many desirable applications. In simplest form, an organic EL device is comprised of an anode for hole injection, a cathode for electron injection, and an organic medium sandwiched between these electrodes to support charge recombination that yields emission of light. These devices are also commonly referred to as organic light-emitting diodes, or OLEDs. Representative of earlier organic EL devices are Gurnee et al. U.S. Pat. No. 3,172,862, issued Mar. 9, 1965; Gurnee U.S. Pat. No. 3,173,050, issued Mar. 9, 1965; Dresner, "Double Injection Electroluminescence in Anthracene", RCA Review, Vol. 30, pp. 322–334, 1969; and Dresner U.S. Pat. No. 3,710,167, issued Jan. 9, 1973. The organic layers in these devices, usually composed of a polycyclic aromatic hydrocarbon, were very thick (much greater than 1 μm). Consequently, operating voltages were very high, often >100V.

More recent organic EL devices include an organic EL element consisting of extremely thin layers (e.g. <1.0 μm) between the anode and the cathode. Herein, the organic EL element encompasses the layers between the anode and cathode electrodes. Reducing the thickness lowered the resistance of the organic layer and has enabled devices that operate at much lower voltage. In a basic two-layer EL device structure, described first in U.S. Pat. No. 4,356,429, one organic layer of the EL element adjacent to the anode is specifically chosen to transport holes, therefore, it is referred to as the hole-transporting layer, and the other organic layer is specifically chosen to transport electrons, referred to as the electron-transporting layer. The interface between the two layers provides an efficient site for the recombination of the injected hole/electron pair and the resultant electroluminescence.

There have also been proposed three-layer organic EL devices that contain an organic light-emitting layer (LEL) between the hole-transporting layer and electron-transporting layer, such as that disclosed by Tang et al [*J. Applied Physics*, Vol. 65, Pages 3610–3616, 1989]. The light-emitting layer commonly consists of a host material doped with a guest material-dopant, which results in an efficiency improvement and allows color tuning.

Since these early inventions, further improvements in device materials have resulted in improved performance in attributes such as operational lifetime, color, luminance efficiency and manufacturability, e.g., as disclosed in U.S. Pat. Nos. 5,061,569; 5,409,783; 5,554,450; 5,593,788; 5,683,823; 5,908,581; 5,928,802; 6,020,078; and 6,208,077.

Notwithstanding these developments, there are continuing needs for organic EL device components that will provide better performance and, particularly, long operational lifetimes. It is well known that, during operation of OLED device, it undergoes degradation, which causes light output at a constant current to decrease. This degradation is caused primarily by current passing through the device, compounded by contributions from the environmental factors such as temperature, humidity, presence of oxidants, etc. However, for practical applications such as display, light output of an OLED device is expected to be nearly constant during useful lifetime of the display. In principle, aging can be compensated by passing more current through the device so that the light output is kept constant. Several methods have been described for adjusting of a current to compensate for device aging. Specifically, WO 99/41732, issued Aug. 19, 1999 to D. L. Matthies et al., included measurement of accumulated driving current as a method to adjust driving current corresponding to a constant luminance. This technique is based on the findings of Steven A. VanSlyke et al. [J. Appl. Phys. 69 (1996) 2160] who reported that the extent of device degradation is dependent on the charge transferred through the device, which is equivalent to accumulated current. However, due to the influence of environmental factors, such as temperature, accumulated current may not be a sufficiently good predictor of OLED device degradation. In above-identified WO 99/41732, as well as in U.S. Pat. Nos. 6,081,073 and 6,320,325, compensation for OLED device degradation is performed by means of utilizing light sensors that are optically coupled to an OLED device. Such methods are complex and can be expensive to implement because they require optically coupled sensors as well as additional electronic circuitry.

There is a need therefore for an improved method of detection of the extent of OLED device aging and compensating for it.

SUMMARY OF THE INVENTION

It is an object of this invention to provide an improved method to compensate for aging in OLED device.

This object is achieved by a method of adjusting the voltage applied across the pixels of an OLED display to compensate for aging, comprising the steps of:

a) measuring the accumulation of trapped positive charge to produce a signal representative of such accumulation; and b) responding to such signal to adjust the voltages applied across the pixels of the OLED to compensate for aging.

This object is further achieved by a method of adjusting the voltage applied across the pixels of an OLED display to compensate for aging, comprising the steps of:

a) controlling a test voltage applied across the pixels of an OLED display to produce an output signal;

b) producing a signal representative of the degradation of the OLED pixels due to aging in response to such output signal; and c) adjusting the input voltages applied to the OLED pixels during normal operation in response to such degradation signal to compensate for aging of the OLED device.

ADVANTAGES

The present invention is advantageous in that it permits a near constant light output of OLED to be achieved by using an electric signal representative of the degradation of the OLED pixels irrespective of environmental conditions without introduction of complex and expensive light sensors.

DETAILED DESCRIPTION OF THE INVENTION

Figure 1:
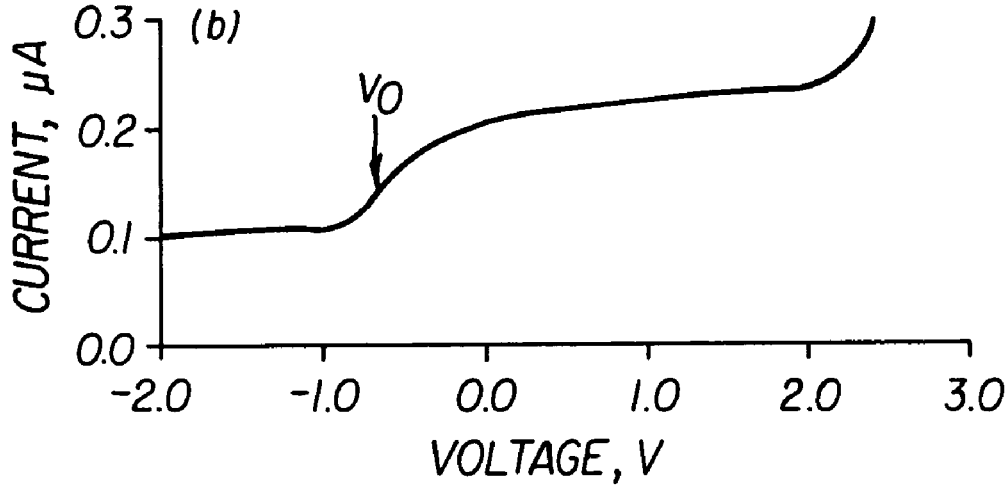
FIG. 1 is a graph showing a voltage sweep of 50 V/s from negative to positive which was used for a particular device in the practice of the present invention.

FIG. 1 shows linear sweep voltammogram, or linear-ramp current-voltage (I-V) measurements, of a typical ITO|NPB (750 Å)|$Alq_3$(750 Å)|Mg:Ag OLED device. In this experiment, the applied voltage (V) is ramped at a constant rate, dV/dt, and the resulting current (I) is recorded. In general, the measured current has two components: a conductive component that would persist with a constant bias; and a capacitive component that is proportional to dV/dt and the differential capacitance. At sufficiently high scan rates (here, 50 V/s) and low applied voltages (here, ≦2.2 V), the current is dominated by the capacitive component. The transition voltage ($V_0$), is operationally defined as inflection points on the I-V curve and identified with an arrow in FIG. 1. A second transition occurs at higher applied voltages, near $V_{bi}$, where the conductive component becomes dominant. The similar behavior above ~2.2 V, regardless of the scan rate, confirms the identification of the transition near this voltage with the onset of significant DC conduction. Below $V_0$, the organic layers act as insulators, and the OLED behaves as a capacitor with the combined organic layers as its dielectric. Above $V_0$, but still at fairly small bias, the OLED behaves as a capacitor with a dielectric layer only half as thick. In a series of devices with different HTL and ETL thicknesses, this capacitance was identified with the ETL. Therefore, above $V_0$, the HTL is short-circuited, and the ETL acts as the dielectric of a capacitor with the NPB|$Alq_3$ interface as one plate and the cathode as the other. The built-in voltage, $V_{bi}$, is estimated to be about 2.1 V from open-circuit photovoltage data. The transition voltage is not only smaller, but in this case it is actually negative. That is, even when the device is short-circuited, there is an accumulation of holes at the HTL|ETL interface, apparently compensating a fixed negative charge. Assuming that the fixed charge indeed resides at (or near) the HTL|ETL interface, its density ($\sigma_0$) can be estimated as approximately $-1.1\times10^{-7}$ C/cm$^2$, using with 3.5 value of dielectric constant.

Figure 2:
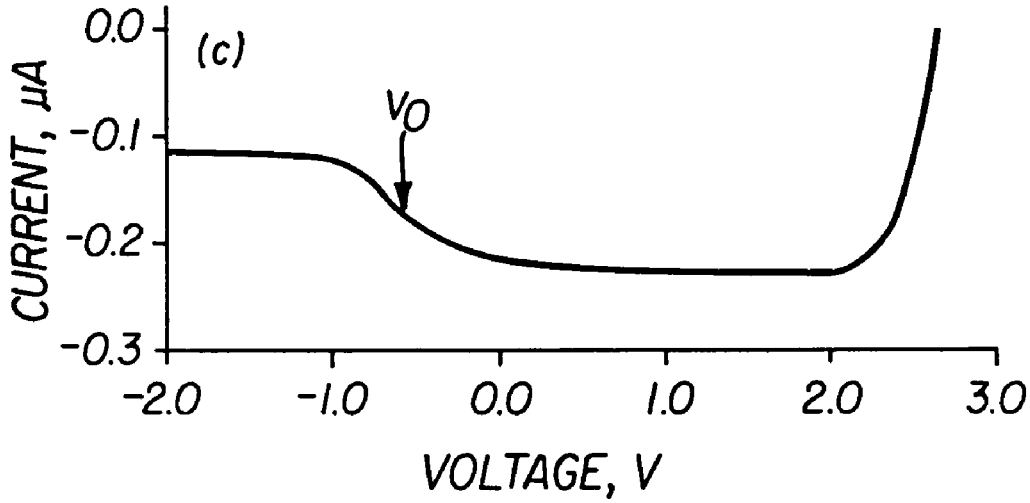
FIG. 2 shows a similar linear voltage sweep to that of FIG. 1, except it is from positive to negative.

In FIG. 1, the voltage was scanned from negative to positive voltage (forward scan, dV/dt=+50 V/s). Most of the voltammograms reported below were scanned in this direction. A scan in the opposite direction (reverse scan, dV/dt=−50 V/s) is shown in FIG. 2. In the capacitance-dominated regime below ~2.2 V, the current is negative, because the device is being discharged. The transition, now from a larger to a smaller capacitance, occurs at the same voltage (within 0.1 V) as for the forward scan curve and identified with an arrow in FIG. 2.

Figure 3:
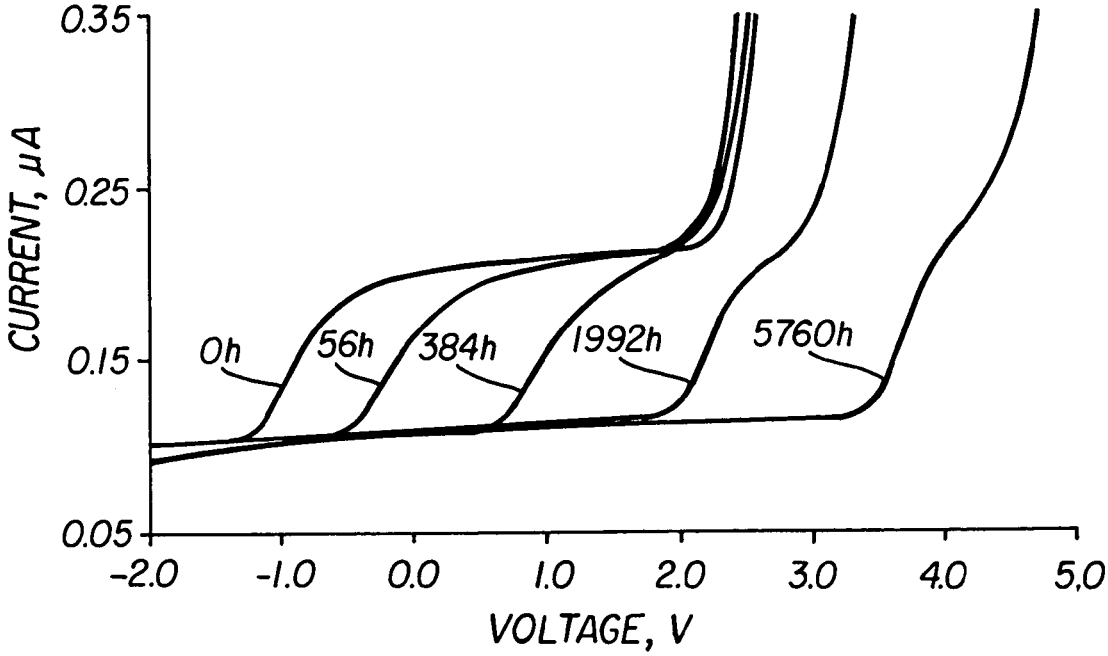
FIG. 3 is a graph of a series of voltage sweeps of different aging times for a particular OLED device different than that referenced in FIG. 1.
Figure 4:
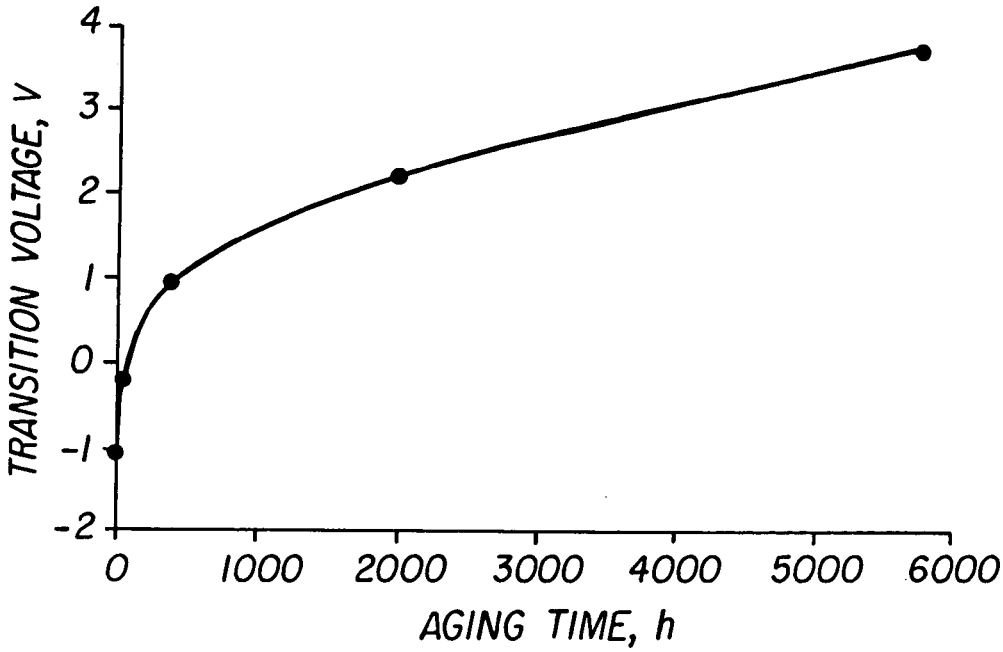
FIG. 4 shows plot of transition voltage as a function of aging time for the OLED device referenced in FIG. 3.

It is well known that, during operation of OLED device, it undergoes degradation, which causes light output at a constant current to decrease. This degradation is caused primarily by current passing through the device, compounded by contributions from the environmental factors such as temperature, humidity, presence of oxidants, etc. FIG. 3 shows a series of forward scan voltammograms taken on a typical NPB|$Alq_3$ OLED before and during electrical aging. This OLED is identical in structure to the device used for FIG. 1, but its transition voltage before aging ("0 h" trace) is somewhat different, illustrating the variation in this quantity among devices fabricated in different runs. The devices were aged in the "AC" mode at an average current density of 40 mA/cm$^2$ (0.5 ms forward bias at 80 mA/cm$^2$ alternating with 0.5 ms reverse bias at −14 V) at room temperature. The transition voltage gradually shifts by several volts towards positive values as the device ages. FIG. 4 shows a plot of $V_0$ as a function of aging time. The transition voltage increases continually, but at an ever decreasing rate, as the cell ages. A datapoint at 5760 h shows that transition voltage can be higher than the built-in voltage, which means that there is a build-up of fixed positive charge during degradation of OLED devices. The difference between transition voltage at a given time and initial transition voltage may serve as a useful measure of an accumulated positive charge and, accordingly, device degradation.

Figure 5:
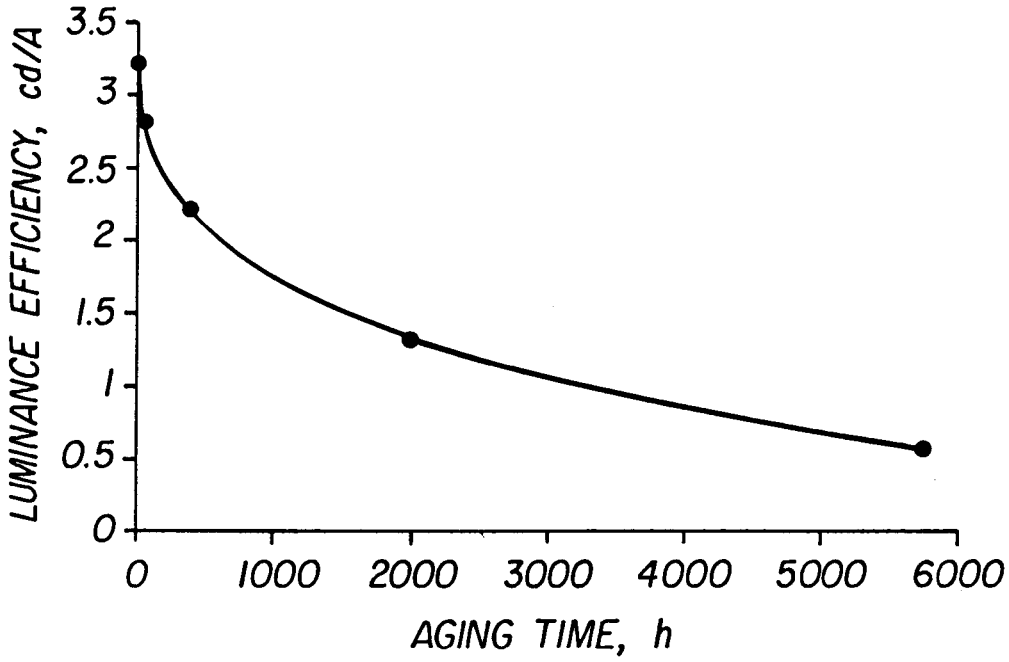
FIG. 5 shows plot of luminance efficiency as a function of aging time for the OLED device referenced in FIG. 3.
Figure 6:
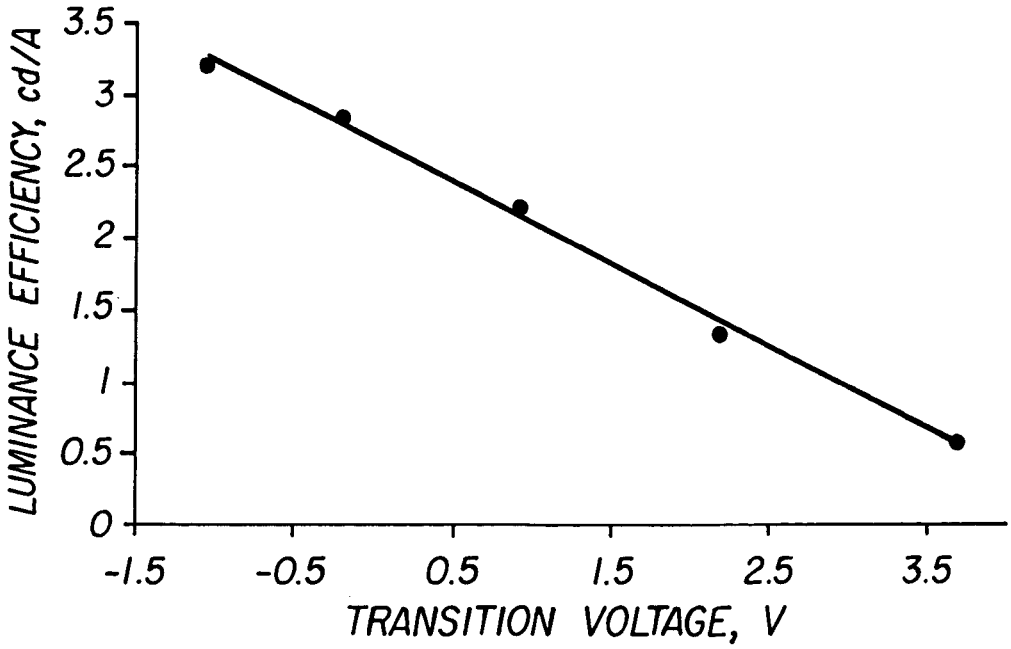
FIG. 6 shows a plot of the correlation between luminance efficiency and transition voltage for aging time for the OLED device referenced in FIG. 3.

FIG. 5 shows a plot of the luminance efficiency of the same cell vs. aging time. Luminance efficiencies are measured at 20 mA/cm$^2$ DC. The luminance efficiency decreases continually, but again at an ever decreasing (and, in fact, nonexponential) rate. FIG. 6 is a plot of the luminance efficiency vs. the transition voltage. Although the two quantities evolve in a nontrivial manner, there is a strong linear correlation between them ($R^2$=0.996). Thus, a linear correlation between the loss of luminance and the rise in transition voltage allows compensating for OLED aging by: (1) measuring transition voltage; and (2) adjusting driving current using measured transition voltage and predetermined parameters (slope and intercept) of a linear correlation between transition voltage and luminance.

Figure 7:
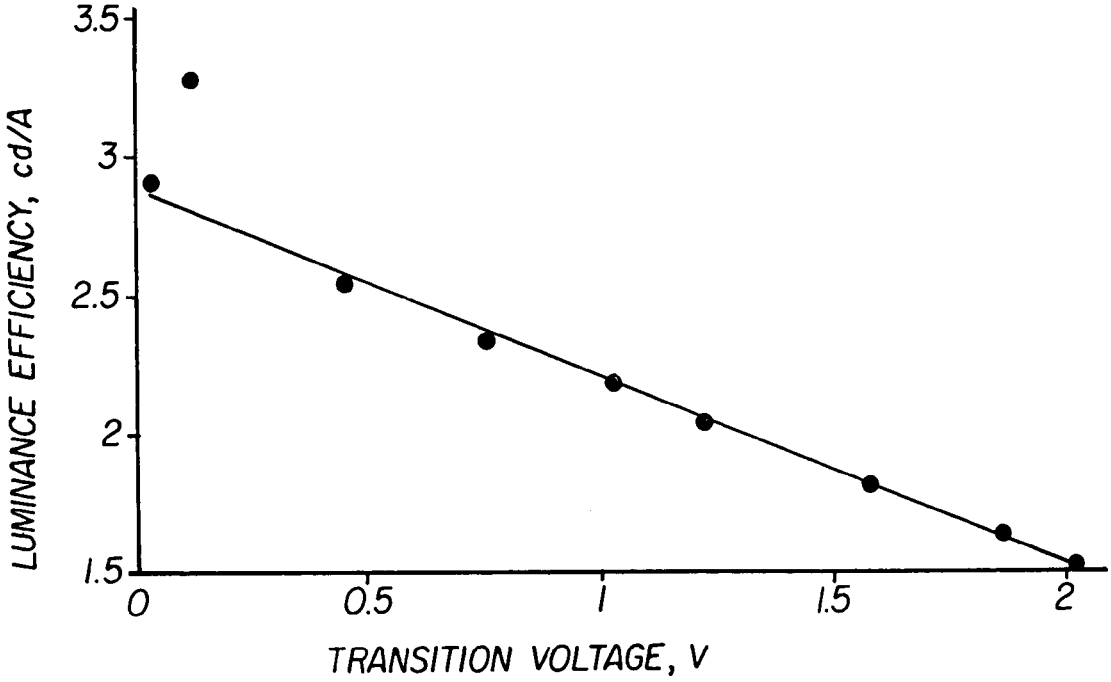
FIG. 7 shows a plot of the correlation between luminance efficiency and transition voltage for a different OLED device than shown in FIG. 3 at elevated temperatures.

Similar correlation between transition voltage and luminance were obtained during aging at different ambient temperatures, current densities, and using DC driving current. When OLED device identical in structure to the device used for FIG. 1 was aged at 70° C. and 40 mA/cm$^2$, the transition voltage increased, and the luminance decreased, approximately five times as fast as at room temperature for the same current density. Nevertheless, as shown in FIG. 7, a linear plot was obtained with a slope (−0.67 cd/A/V) similar to that for room-temperature aging. In this case, during the first several hours, the luminance dropped while the transition voltage actually decreased, so that the first data point fell above the trend line and was removed from correlation. It should be mentioned that devices stored at room temperature or 70° C., but not driven electrically, exhibit only subtle changes. Hence, transition voltage may be used to evaluate a degree of degradation of OLED devices irrespective of the conditions (temperature, current density, AC or DC current) in which degradation process took place.

Figure 8:
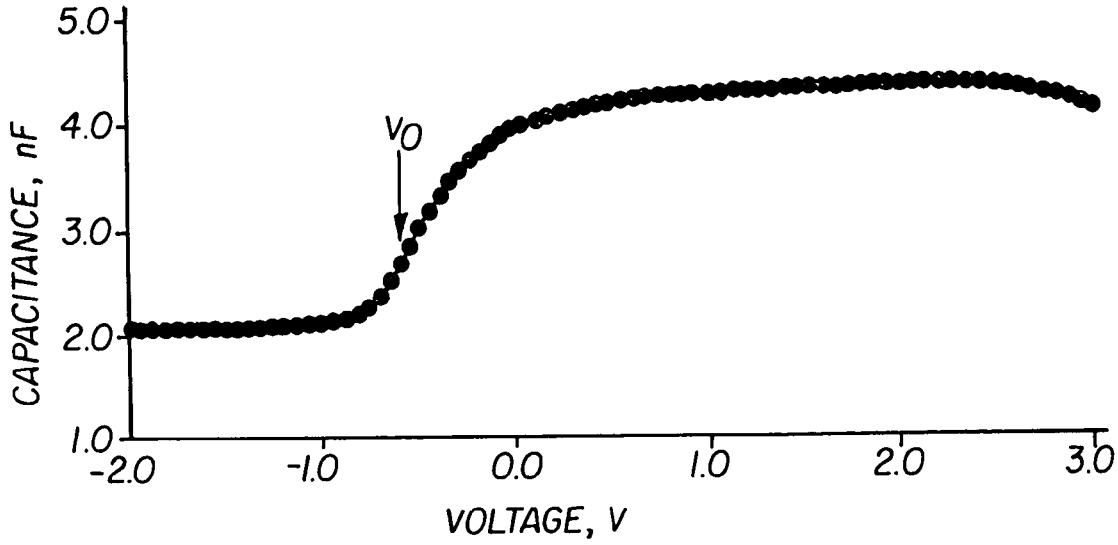
FIG. 8 shows capacitance vs. voltage for the OLED device referenced in FIG. 1.

As described above, the transition voltage ($V_0$), is operationally defined as inflection points on the I-V curve. Nearly equivalent value (within 0.1V) can be obtained as an inflection point in C-V curve from an AC impedance measurement. An example of C-V curve is shown in FIG. 8 for the same OLED device as in FIG. 1. The capacitance is measured in response to a sine wave of amplitude 0.05 V and frequency 109 Hz. The inflection point (arrow) is identified with the transition voltage $V_0$.

Figure 9:
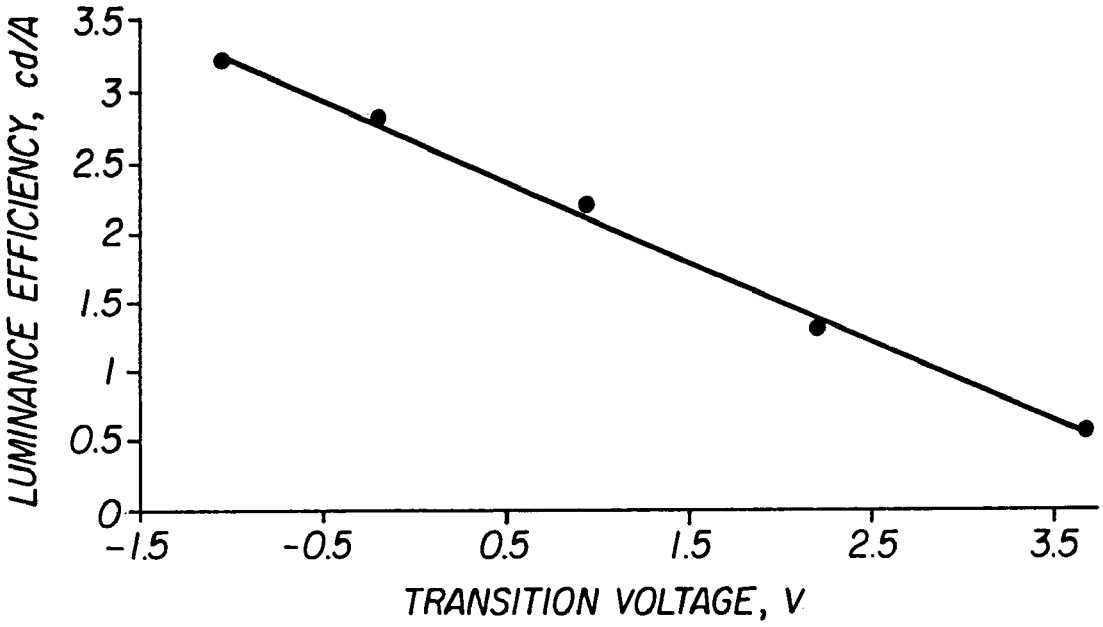
FIG. 9 shows a plot of correlation between luminance efficiency and midpoint transition voltage for the OLED device referenced in FIG. 3.

Instead of using an inflection point on I-V or C-V curves, which requires electronic circuitry to perform differentiation, a voltage corresponding to a midpoint of the transition (for example, for the I-V curve, midpoint voltage is defined as voltage corresponding to the current equal to the average of current before and after the transition) can be used as a measure of an accumulated positive charge and, accordingly, an OLED device degradation. FIG. 9 shows the correlation between luminance and a transition midpoint voltage. Comparison with the correlation in FIG. 6 shows that the transition midpoint voltage is suitable as a measure of an accumulated positive charge and, accordingly, device degradation.

Figure 11:
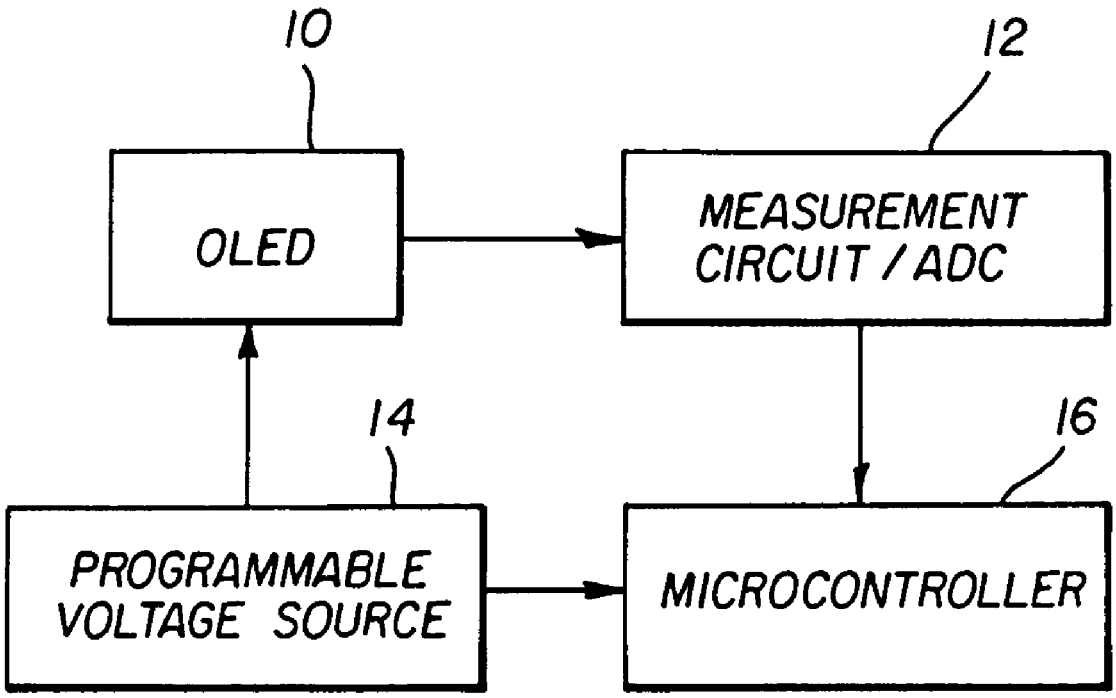
FIG. 11 shows a block diagram of a system for practicing the present invention.

FIG. 11 shows a block diagram of a system, which can practice the present invention. During the measurement and calculation stage, a microcontroller 16 controls a programmable voltage source 14 to provide a test signal, preferably a voltage ramp 18 (variable voltage) with constant dV/dt, which is applied across the pixels of an OLED display 10 to produce an output signal. Alternatively, a test signal can be an AC voltage suitable for AC impedance measurement. A signal representative of the degradation of the OLED pixels due to aging is produced by measurement circuit/ADC 12 and processed by microcontroller 16 to calculate the extent of OLED device degradation. This signal is actually a measurement of the accumulation of trapped positive charge. Processing is preferably done by differentiation and finding voltage corresponding to the maximum on the derivative-I-V data, or by finding a voltage corresponding to a midpoint of a transition. In this case, measurement circuit/ADC 12 actually includes a current measuring circuit, which produces a signal that is differentiated to include a representation of the degradation of the OLED pixels due to aging. For example, for the I-V curve, midpoint voltage is defined as voltage corresponding to the current equal to the average of current before and after the transition.

Figure 10:
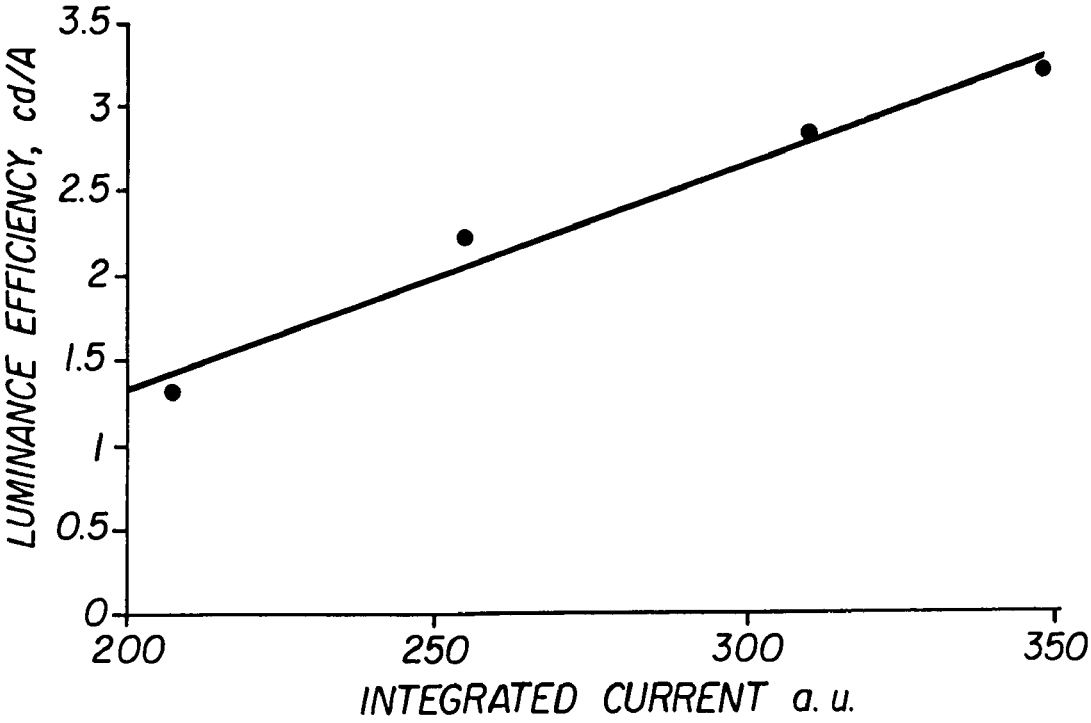
FIG. 10 shows the correlation between luminance and integrated current for the OLED device referenced in FIG. 3.

Alternatively, an integrating circuit, simplest example being a resistor-capacitor circuit, can be employed to integrate voltammometric I-V curve, yielding a measure of an accumulated positive charge and, accordingly, device degradation. For example, FIG. 10 shows a correlation between luminance and integrated current between −1.3 and 2.3 V from I-V traces shown in FIG. 3 (with exception of "5760 h" trace, which has transition voltage above the integration range). As evidenced by FIG. 10, integrated current is also suitable as a measure of an accumulated positive charge and, accordingly, OLED device degradation.

Measurement and calculation stage takes place periodically, preferably during each power-up procedure for activating an OLED display. The measurement can take place in response to a timing clock provided in the microcontroller 16 which measures the time that the OLED display has been activated, and therefore this would be performed periodically during OLED display operation. Alternatively, measurement and calculation stage takes place at predetermined intervals. Adjustment of the voltage applied across the OLED pixels by the programmable voltage source 14 to compensate for aging is then accomplished. Since the voltammetric measurement can be performed in submillisecond timeframe, the measurement and calculation stage can be executed on an operating OLED device without interfering with an image perceived by user. A signal representative of the accumulated charge is produced within the microcontroller 16. In response to this signal, to compensate for aging, the microcontroller provides an input to the programmable voltage source 14 that changes the voltage applied across the OLED to compensate for aging. It will be understood that the microcontroller 16 can include a map which has been previously determined for determining an adjustment signal that is applied to the programmable voltage source 14.

Microcontroller 16 uses the predetermined extent of OLED device degradation to calculate the required current, preferably based on the following equation that predicts a current required to produce an unchanged luminance level.

$$I=aV+b$$

Here, I is a required current, V is measure of device degradation (inflection or midpoint transition voltage from I-V or C-V traces, or integrated current from I-V traces). The values of coefficients a and b are preferably determined by the separate aging calibration performed during short initial time (pre-burn) on the same device or during suitable aging time on a comparable device.

Alternatively, the calculation of the current required to produce an unchanged luminance level is based on the following equation that uses a change in measured extent of device degradation:

$$I_t=a(V_t-V_0)I_0.$$

In this example, $I_t$ is a required current at this time, $I_0$ is a previous required current, $V_t-V_0$ is a change in the extent of device degradation (difference in inflection or midpoint transition voltages from I-V or C-V traces, or integrated currents from I-V traces). The value of coefficient a is preferably determined by the separate aging calibration performed during short initial time (pre-burn) on the same device or during suitable aging time on a comparable device.

The calculated value of required current is then used by microcontroller 16 to adjust the input voltages applied to the OLED pixels during normal operation in response to such degradation signal to compensate for aging of the OLED device.

The present invention can use a single test pixel in the OLED device, or can use representative pixels in the array of OLED pixels, or every pixel in the array of OLED pixels. Separate signals can be produced for different colored OLED pixels as they can age differently, since they have different fluorescent dyes.

The invention has been described in detail with particular reference to certain preferred embodiments thereof, but it will be understood that variations and modifications can be effected within the spirit and scope of the invention.

PARTS LIST

10 OLED display
12 measurement circuit/ADC
14 programmable voltage source
16 microcontroller

What is claimed is:

1. A method of adjusting a voltage applied across the pixels of an OLED display to compensate for aging, comprising the steps of:

a) varying a test voltage applied across the pixels of an OLED display to produce an output signal representative of the accumulation of trapped charges;

b) producing a signal representative of the degradation of the OLED pixels due to aging in response to such output signal; and c) adjusting input voltages applied to the OLED pixels during normal operation in response to such degradation signal to compensate for aging of the OLED device.

2. The method of claim 1 wherein step c) includes current calculation using the following equation:

$$I=aV+b$$

where, I is a required current, V is measure of device degradation (inflection or midpoint transition voltage from I-V or C-V traces, or integrated current from I-V traces), and the values of coefficients a and b are preferably determined by the separate aging calibration performed during short initial time (pre-bum) on the same device or during suitable aging time on a comparable device.

3. The method of claim 1 wherein sequence of steps a), b), and c) is performed during a power-up procedure.

4. The method of claim 1 wherein sequence of steps a), b), and c) is performed periodically during OLED device operation.

5. The method of claim 1 wherein step a) includes application of voltage ramp with constant dV/dt.

6. The method of claim 1 wherein step a) includes producing an AC voltage suitable for AC impedance measurement.

7. The method of claim 1 wherein step b) includes providing a current measuring circuit to produce a signal and differentiating such signal to provide a signal representative of the degradation of the OLED pixels.

8. The method of claim 1 wherein the output signal is a current signal and step b) includes an integrating circuit that integrates the current signal and measures the integrated current signal produced by the integration circuit to produce the signal representative of the degradation of the OLED pixels.

* * * * *